US010449433B1

(12) United States Patent
Bennett

(10) Patent No.: US 10,449,433 B1
(45) Date of Patent: Oct. 22, 2019

(54) WAVE ENERGY AND RIP CURRENT CONTROL SYSTEM FOR SURF POOLS

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 0 days.

(21) Appl. No.: 15/965,945

(22) Filed: Apr. 29, 2018

(51) Int. Cl.
*A63B 69/00* (2006.01)
*A63B 69/12* (2006.01)
*E04H 4/00* (2006.01)

(52) U.S. Cl.
CPC ..... *A63B 69/0093* (2013.01); *A63B 69/125* (2013.01); *E04H 4/0006* (2013.01)

(58) Field of Classification Search
CPC .. E04H 4/0006; A63B 69/0093; A63B 69/125
USPC ..... 405/79; 4/491
See application file for complete search history.

(56) References Cited

U.S. PATENT DOCUMENTS 4,979,243 A 12/1990 Teratsuji et al.
6,460,201 B1 11/2002 Lochtefeld
7,727,077 B2 6/2010 Henry et al.
7,775,895 B2 8/2010 Henry et al.
8,561,221 B2 10/2013 Lochtefeld
2008/0060123 A1 3/2008 Johnson
2008/0166187 A1* 7/2008 Johnson ..... F04D 35/00 406/79
2009/0038067 A1* 2/2009 Johnson ..... F04D 35/00 4/491
2009/0151064 A1 6/2009 Mladick
2009/0185863 A1* 7/2009 McFarland ..... A63G 31/007 405/79
2010/0088814 A1 4/2010 Johnson
2011/0099707 A1* 5/2011 Klimaschewski ... A63G 31/007 4/491
2012/0183353 A1 7/2012 Davis
2014/0000020 A1 1/2014 Von Groll
2015/0033465 A1 2/2015 Lochtefeld
2015/0107013 A1 4/2015 Lochtefeld

* cited by examiner

*Primary Examiner* — Carib A Oquendo

(57) ABSTRACT

The invention relates to a Surf Pool wherein a portion of the beach is provided with a wave catch basin. With the wave catch basin extending along the length of the beach, the wave catch basin will allow water to go over an infinity edge and settle in the wave catch basin, wherein wave energy backflows are eliminated and rip currents are avoided. With the wave catch basin extending along the beach side of the surf pool, the water that is collected in the wave catch basin and by pumping water out of pipe fittings or creating positive suction into pipe fittings, alters the flow of the rip current, thereby altering the wave formation characteristics. As the rip currents enter the rip current flow channels on both sides of the surfing reef, water can be suctioned down through return pipes or pumped in any direction along the surf pool bottom to stop the rip currents in the rip current flow channels, which helps the breaking waves from becoming distorted as they break.

2 Claims, 5 Drawing Sheets

WAVE ENERGY AND RIP CURRENT CONTROL SYSTEM FOR SURF POOLS

FIELD OF THE INVENTION

The present invention relates to the field of surf pools, and in particular, to a surf pool that generates large surfing waves and has been adapted to control wave energy or reduce rip currents to allow for clean glassy waves without wave shape distortion.

BACKGROUND OF THE INVENTION

One of the things that make ocean beaches so appealing and exciting is the surf. Also, nothing is more fun than jumping into the water and playing in the surf, feeling the power of the waves crashing ashore. Unfortunately, the unpredictable nature of the surf and its power result in many injuries and deaths each year, even affecting experienced swimmers and surfers.

The thousands of waves that strike a beach every day are generated by the wind. Generally speaking, as the wind speed increases so does the surf. Waves that break on beaches can be locally generated or be spawned thousands of miles away by storms at sea. Hurricanes cause the largest waves, termed swell, along the Atlantic Coast, while migratory low-pressure cells (e.g., storms) at high latitudes generate the great Pacific Ocean swells. The north shore of Oahu, Hi. is directly exposed to these giant ocean swells that can reach 30 feet high during the international surfing contests in January. These huge swell waves are hitting beaches when the weather is perfect—sunny and cloud free.

Wave height is the primary determinant of rip current strength, but wavelength is also significant. Wavelength refers to the width of the wave, which is measured from trough to trough. The height and width determine the volume of water in a wave. Some waves that peak when breaking may appear powerful, but there is no real force behind them without a large mass of water. By contrast, the big swells that dominate the Pacific coast tend to have long wavelengths, making them very powerful waves that break with considerable force.

It is nearly impossible to measure wavelength when in the water, but you can easily count in seconds the time between waves as they break. The greater time between plunging breakers (termed the wave period), the longer their wavelength and consequently the greater the force for a wave of a particular height. Long-period swell waves of around 20 seconds are the best surfing waves along the Southern California Coast, but these turbulent waters are best avoided for swimming; I suggest heading to the nearest heated surf pool.

High waves can be quite dangerous. What is not understood by the public is that the energy is proportional to the height of the wave squared. Therefore, a three-foot wave is nine, not three, times more powerful than a one-foot wave. Onshore breaking waves that exceed five feet are generally too dangerous for bathers and swimmers. Experienced surfers look for the big waves, but good surfing beaches are often dangerous for swimming.

The two primary types of breaking waves are plunging and spilling. Plunging waves are by far the most exciting and dangerous, being characterized by great force and velocity. Plunging breakers are formed when swell suddenly encounters a shallow bottom, such as a reef, large sand bar or steeply-sloping beach. The wave is forced to peak up and break suddenly with all of its force concentrated in a limited area. Plunging waves often generate rip currents and shore breaks on steep beaches and are responsible for many more injuries than spilling or surging waves.

Spilling breakers, which are more common and much less imposing, lose their energy over long distances in contrast to plunging waves. The breaking water rolls or tumbles forward as the wave advances into shallower water, producing a wide surf zone. Spilling waves generally provide safe conditions for waders, swimmers, and boogie boarders; the U. S. East and Gulf coast beaches are most often subject to this type of breaking waves.

What Causes Rip Currents

Waves contain the energy that generates currents at beaches. These currents are the ones that primarily affect bathers and swimmers and extend from the shoreline to the outermost breakers (e.g., the surf zone). Tidal jets are another dangerous current (totally unrelated to waves) that occur locally at inlets or other constrictions; these strong currents are caused by the flooding and ebbing tides.

Wave breaking produces swash—the water that moves up and down a beach face. The sheet of water moving up the beach is called the swash uprush or just uprush. The larger the breaking wave, the deeper and faster moving is the uprush. The swash that does not sink into the sand is then drawn by gravity down the beach as water seeks its own level. When the waves are high and the beach is steep, the swash backwash can be powerful and is sometimes called undertow, which can knock you around, but is seldom a problem except for children.

Undertow, which is strong backwash, only pulls you into, but not beyond the wave breaking on the beach. The effect of the wave breaking over the top of you can give the impression of being sucked under the wave, hence the concept of undertow.

Some beach communities, especially along Southern California and Hawaii, post signs warning swimmers of undertow during big wave days. Undertow is the one thing that many beachgoers have heard about, yet the real danger is rip currents.

On big wave days, especially with large plunging breakers, the swash can be quite strong; the water shoots up the beach face, providing a good ride for boogie boarders. The backwash of the swash is particularly problematic on steeply-inclined beaches near the time of high tide. This return flow of water that is caused by gravity can topple people—it is difficult to maintain your footing in the swift current as you are pulled forcefully toward deeper water. While this current can be overpowering during times of big plunging waves, it will not take you beyond the breaker line (unlike a rip current which carries you offshore through the surf zone). Of course, it can be dangerous if you are pulled into the next large plunging wave that is breaking into shallow water (e.g., shore break conditions).

The most frequently encountered current by bathers and swimmers on ocean beaches is the longshore current, which is produced by waves breaking at an angle to the shoreline. Surf Pools will face these same dangerous rip currents. Anyone who has spent time on surf beaches has experienced this current that moves you along the shore, but not offshore. Sometimes the current is so gentle that you don't even feel it moving you; it is not until you get out of the water to find your towel that you realize its effect. Other times, especially when the breaking waves are coming from an oblique angle to the shoreline and are quite large, this current can feel like a river flow (you really should not be in the water during these conditions). In fact, the longshore current is responsible for huge quantities of sand movement, making beaches a "river of sand." These same dangerous conditions can also occur in surf pool with big surfing waves in high frequency.

Rip currents are caused by water being pushed up the beach above mean sea level by large breaking waves. Swashes generated by plunging breakers of large swell waves are the most effective in producing the conditions for rip generation. As in the normal swash process, this water that is piled up on the beach is subject to gravity, pulling it back down the slope to the sea surface. Subsequent large breaking waves can continue to pile the water up on the beach, causing a temporary damming effect. Water will follow the path of least resistance, such as an underwater trough or along a groin, in seeking its own level. A concentrated flow of returning water to the ocean becomes a rip current, moving away from the beach toward the offshore.

Rip currents have three components—feeder, neck and head. Oftentimes this mushroom shape is not present or apparent to beachgoers from the vantage point of the water's edge.

The feeder current is the main source of water for the rip. Water that has been pushed and piled up on the beach is often moved along the shore for a short distance by the feeder currents to the underwater channel or trough. Once the water reaches the channel or encounters an obstacle to its along-the-shore movement, it will turn seaward as a rip current.

There may be one or two feeder currents, depending upon the wave approach and prevailing longshore current.

The neck section is where the concentrated flow of water moves from the beach through the surf zone. Current speeds are quite fast, often reaching 2-3 feet per second and measured to be as high as 6 feet per second along some Australian high-surf beaches. The neck of the rip can vary in width from a few yards to tens of yards. The majority of both rescues and drownings occur when people are being pulled offshore in the rip neck. The rip head, which sometimes has the classic mushroom shape, develops where the current has moved beyond the surf zone.

Rip currents typically form in pronounced breaks or "holes" in the nearshore bar or reef, which serve as the conduits for the strong seaward-flowing current. Such strong currents could scour holes in the inner bar or reef.

Artificial surf reefs (ASRs) are structures specifically aimed at modifying the nearshore wave field transformation to improve surfing conditions or surfability. With the increasing popularity of surfing, the demand for such artificial reefs is ever growing. Artificial Surf Reefs (ASRs) are planned to be constructed in big surf pools for indoor and outdoor surfing. Nevertheless, artificial surf reef design is often done fairly ad hoc and there remains great uncertainty as to what the optimal dimensions of the artificial surf reef should be.

In Artificial Surf Reefs, Henriquez (2004) investigated, through a combination of numerical and experimental modelling, how Artificial Surfing Reefs design affects the resulting surfability. The quality of a surf break is generally expressed in three measurable parameters: breaker height, peel angle and breaker shape. Together these parameters determine the surfability of the wave. In particular, the peel angle (a measure related to the rate at which the wave breaks along its crest) is an important measure that plays a dominant role in Artificial Surfing Reefs design. The numerical modelling (Henriquez, 2004) was done without taking into account wave-driven currents. The experimental modelling by Henriquez showed that, approximately 20% of the wave ride was negatively affected by rip currents driven by wave breaking over the ASR. The waves in the rip current were breaking in sections, irregular and with a rough water surface, in other words: unsuitable for surfing.

Over the last ten years numerous Artificial Surf Reefs in surf pools have been designed and a few are actually built. In order to design an artificial surf reef, it is important to understand the basics of ocean wave transformation over topography, including the effects of e.g. shoaling, refraction and diffraction. It is also important to understand waves from a surfer's point of view to understand what kind of wave an ASR should produce. The interaction between the waves and the reef are explained in this current invention.

In previous research (Henriquez, 2004), the currents driven by wave breaking over the reef had not been taken into the design. It appeared that wave-driven currents play an important role in ASR design.

Peel Angle

Surfable waves never break all at once along the wave crest. If this occurs, surfers would say that the waves are closing-out and not suitable for surfing. In order for a wave to be surfable, the wave has to break gradually (read peel) along the wave crest. The velocity with which this happens is called the peel rate.

The peel angle is the most important surfability parameter. The peel angle is the angle $\alpha$ enclosed by the wave crest and the breaker line (In Recreational Surf Parameters, University of Hawaii, Walker, 1974). Also, the wave celerity c and the peel rate Vp vectors are indicated. The absolute value of the vector sum of these velocities is the actual velocity experienced by the surfer, called down-line velocity Vs, which is the magnitude of the velocity vector along the breaker line.

Whether a wave is surfable or not depends mainly on the value of the peel angle $\alpha$. The down-line velocity is related to the peel angle. Thus, when the peel angle becomes too small, the down-line velocity becomes very high and too fast for the surfer. The value of the peel angle needs to be sufficiently large in order for a wave to be surfable. The velocity a surfer can reach depends, mainly on the wave height H and the skill of the surfer. In, "Classification of surf breaks in relation to surfing skill", Hutt et al. (2001) investigated what the necessary peel angle has to be for a given wave height H and surfer skill.

The higher the waves, the smaller the peel angle can be; likewise, with increasing surfer skill a smaller peel angle can is acceptable. The definition of these surfer skills and the peel angle related to the skill of the surfer and the wave height are described in Hutt et al. (2001).

The phenomenon of peeling waves is not as obvious as one would think. Waves approaching a sloping shore with straight and parallel depth contours under an angle $\theta$ will refract such that the wave angle at breakpoint $\theta b$ of the waves is nearly zero. The main challenge of an Artificial Surfing Reef is to obtain peel angles which are large enough to be surfable. This can be achieved by using a reef with relatively steep slopes and with an angle $\beta$ enclosed between the reef normal and the beach normal. The ASR, and thus, wave refraction over the reef, has to start in sufficiently shallow water such that the peel angles can be large enough for surfing purposes. This can be understood by considering Snel's law:

where c is the wave celerity and $\theta$ is the wave angle, subscripts b and r denote the breakpoint and the depth at which the reef starts respectively. Snel's law only applies to an alongshore uniform beach and therefore the wave angles must be defined with respect to the reef normal. Then the break angles θb are replaced with the peel angles α and Equation becomes:

$$\alpha=(2.2)$$

With θr constant, variations of the depth at which the reef starts hr only weakly affect cb. Then it follows from Equation 2.2 that the peel angle α is directly related to the wave celerity cr. By decreasing the depth at which the reef starts, the wave celerity cr is decreased resulting in higher peel angles.

Wave Height:

Waves can be surfed from 0.15 m up to 25 m high. Long boarders start surfing when waves are 0.5 m, while some professional surfers still surf waves of 25 m. In general, most recreational surfers are surfing waves between 1 m and 3 m. The wave height at the take-off can be increased by the artificial surf reef, using the phenomenon of wave focusing. Wave focusing occurs where wave rays converge due to wave refraction. Due to wave focusing the wave heights along the wave crest have a gradient, the part with high wave heights will break in deeper water than the part with low wave heights, resulting in a breaker line not parallel to the depth contours. This can also affect the peel angles. The effect of wave focusing on the peel angle can only be estimated with the use of numerical models do to the complexity of the combined effects of wave refraction and diffraction.

Breaker Shape:

The shape of a breaking wave is of great importance for surfing. The breaker type is a means of classifying the shape of breaking waves. The main surfable types are:

- Spilling breakers occur if the wave crest becomes unstable and flows down the front face of the wave producing a foamy water surface. Surfers would say a 'weak' wave.
- Plunging breakers occur if the crest curls over the front face and falls into the base of the wave, resulting in a high splash. Surfers call this a 'tubing wave'.
- Collapsing breakers, these breaking waves occur if the crest remains unbroken and the front face of the wave steepens and then falls, producing an irregular turbulent water surface-surfers often encounter this regime at reef breaks when the tide is too low and the reef is not submerged enough to produce surfable waves, and so it is an unsurfable regime.
- Surging breakers these waves occur if the crest remains unbroken and the front face of the wave advances up the beach with minor breaking. His regime is also unsurfable.

Currents around a surf break are of vital importance when considering the surfability of the break. Rip-currents, narrow strong currents that move seaward through the surf zone negatively affects good surfable waves. When the rip-current flows through the breakers, the wave appears to get a rough surface and breaks in an irregular manner, making the waves unsuitable for surfing. Rip-currents can be advantageous as well; the surfer can use the rip-current to get easily outside the breaker zone. It can also be the case that the waves are perfectly surfable, but yet unreachable due to strong currents.

It is observed by Henriquez (2004) in his experiment that waves in a rip current break irregular and in sections. This might be caused by variations in the velocity of the rip-current. These variations in wave heights can be the cause of the irregular and in sectional breaking of the waves. It turns out that for the conventional Artificial Surfing Reef rip currents negatively affect approximately 20% of the wave ride. Thus in order to design an improved Artificial Surfing Reef the wave-driven currents over the reef have to be taken into account. In other words, the currents which are flowing through the breakers have to be minimized. Therefore, it is important to understand the driving mechanism of the wave-driven currents over the conventional ASRs.

The main driving mechanisms for the rip currents through the breakers caused by the artificial reef are the currents induced by differences in pressure gradients. These pressure gradients occur due to differences in breaker heights over the reef and at the sides of the reef. The rip currents are also driven by the along shore currents.

PRIOR ART

In Lochtefeld, U.S. Pat. No. 8,561,221B2, teaches away from the current invention, because first wave forming portion with an inclined section oriented obliquely relative to the travel direction of the waves, and a second wave dampening portion having a relatively deep solid chamber floor and a raised perforated floor above it for dampening the waves. The wave dampening portion preferably dissipates the waves, which in turn, reduces wave reflections and rip currents that can otherwise interfere with the oncoming waves. Provided by Lochtefeld is the inclusion of a wave dampening chamber that is situated downstream from the inclined section, i.e., in the downstream portion of the wave pool. The wave dampening chamber preferably comprises a relatively shallow raised or "false" perforated floor that extends above a relatively deep solid chamber floor. The raised floor is preferably provided with multiple openings, or perforations, that allow a predetermined amount of water and wave energy to pass through—both up and down and through the openings.

Lochtefeld in U.S. Pat. No. 8,561,221B2, teaches away from the current invention because it uses perforated flooring to dampen the wave after it breaks and to reduce wave reflection and rip currents. The current invention teaches away from Lochtefeld, because the current invention uses rip current flow channels.

In Lochtefeld, U.S. Patent 64/602,0161, teaches away from the current invention (1) providing one or more grates on the pool floor and along the beach side of the pool to allow water and energy from a generated wave to pass through into a cavity below, such that wave breaking characteristics can be controlled, reverse flow minimized, and rip currents reduced; and (2) providing a spatial sequencing in pool bottom topography that allows a generated swell to break, reform into an unbroken swell, and then break again. That is, as each wave breaks and its forward momentum causes water to flow up onto the beach, water is allowed to pass through the grated floor, and into the cavity below, such that virtually none of the water is allowed to flow back onto the inclined floor of the beach and flow back down again against the oncoming waves. In such case, most of the water that would otherwise flow up the beach simply passes through the grated floor and is effectively removed from the beach to reduce rip currents. Another aspect of the invention in Lochtefeld, is that it preferably has a circulating means to allow water to circulate from one end of the pool to the other, and then back again, without interfering with wave formation. As the wave generating machine generates waves, the waves will travel across the pool and onto the beach area, but as water flows through the grated floor, and into the cavity below, water will tend to build up and spill over back onto the sloped floor, thereby defeating the purpose of the invention, unless a circulation means is provided. The circulation means of the Lochtefeld invention can be an underground channel that extends under the pool floor and connects the beach end of the pool to the end where the wave generating machine is located.

Lochtefeld, U.S. Pat. No. 6,460,201B1, teaches away from the current invention, because it uses a grate over top of a cavity, to collect water from the wave after it has broken to remove rip currents from the pool and to re circulate the water through channels located under the pool floor to the rear generator portion of the wave pool. In the invention the cavities do not attach to side reservoirs. The invention also does not use piping or pipe fittings to intake or return water to the reefs to mitigate nor prevent rip currents in the surf pool. Lochtefeld also teaches away, because the invention uses positive suction for the main purpose of removing wave energy and mitigating rip currents, also in Lochtefeld removes current through using a hydraulic gradient through the grates on the pool bottom. Lochtefeld does not teach of any rip current flow channels to mitigate rip currents as in the current invention.

In Carnahan & Mladick, US Patent US20090151064A1, teaches away from the current invention because is a wave pool comprising a pool, a wall at a periphery of the pool, and an infinity wave catch edge at the wall. The wave pool as recited in claim 23, wherein the infinity wave catch edge is substantially lower than another edge of the wave pool, thus allowing the pool wall to have height that can accommodate waves produced by a wave generator. The wave pool as recited in claim 23, wherein the infinity wave catch edge is configured to calm the wave pool after the wave travels through the pool. A wave pool comprising a generally round pool and a plurality of drains disposed around a periphery of the pool and configured to facilitate catching and stopping waves and to facilitate returning water back to proximate the center of the pool. The wave pool as recited in claim 20, further comprising piping connected to the drains and extending under the pool floor, the piping returning the water back to proximate the center of the wave pool.

The wave pool as recited in claim 20, further comprising a deep water return channel having an incline slope from the deep end of the pool toward the shallow end of the pool. A wave pool comprising an outer channel and pressurized water jets disposed at the outer channel and configured to force water upward so as to tend to break up currents in the wave pool. A wave pool comprising a wall and an infinity wave catch edge formed substantially along the wall. The wave pool as recited in claim 32, wherein the infinity edge is substantially lower that an edge of the wave pool. The wave pool as recited in claim 32, wherein the infinity edge is configured so as to tend to calm the wave pool after a wave travels through the wave pool.

Carnahan & Mladick US Patent US20090151064A1, further teaches away from the current invention, because it teaches of an infinity edge around the wall parameter of the wave pool, where water can fall into a catch or channel and be directed to various locations of the wave pool. Carnahan & Mladick does not use rip current flow channels to prevent or mitigate rip current or reduce the wave energy in the wave pool unlike in the current invention.

In Johnson, US Patent 20100088814A1, teaches away from the current invention, wherein the solid inclined projection forms a peaked inverted V shape that extends from the middle of the wave pool toward each side terminating prior to reaching each side thereby creating deep side channels that extend substantially the length of the wave pool up to the beach area along each side. The wave pool of claim 6, further comprising deep side channels separating the end of the artificial reef from the side of the pool by at least 18".

In Johnson US Patent 20100088814A1, teaches away from the current invention because Johnson teaches about deep side channels that are used in assisting to break waves and does not teach about preventing or mitigating rip currents or removing wave energy from the wave pool, using rip current flow channels as in the current invention. Johnson also teaches that the deep channels between the artificial surfing reefs are used to separate the reefs.

In Johnson, US Patent 20100011497, The present invention relates to wave pools and diversion channels that capture high kinetic energy portions of a wave generated within the wave pool and redirects the captured wave portions to the vicinity of wave formation, preferably timed so as reinforce a subsequently generated wave. The high kinetic energy within the diversion channel creates an additional feature in the form of an action river for riders of a wave pool to enjoy. At the same time, capturing of portions of the wave reduces the backwash of the wave and stabilizes the level of water within the wave pool, especially for embodiments with wave generators and pools capable of high volume waves. Riders may enter the diversion channel and ride from the distal, beach end of the wave pool to the proximal, wave generating end.at least two islands disposed in the bottom defining at least two integrated diversion channels having a depth substantially greater than that of the reef contour and dissipative beach, wherein the at least two integrated diversion channels further comprise an inner side formed by the at least two islands, an outer side formed by the pool side, a wave entrance disposed in the distal portion and facing open at least in part to the proximal portion, and a wave discharge disposed in the proximal portion and facing open to the distal portion, the outer sides being substantially non-dissipative, and wherein the reef contour and the diversion channels are configured to capture a high energy portion of the waves within the diversion channel and to redirect the captured portion of the waves from the distal portion of the body of water to the proximal portion of the body of water, with the captured portion of the wave exiting the wave discharge and moving in a proximal to distal direction.

The method of claim 11, wherein the pool further comprises a tidal pool disposed intermediate the reef contour and the dissipative beach, and wherein the tidal pool is configured to receive water from the waves and to provide water to the diversion channels so that water moves from the distal portion to the proximal portion of the body of water.

The method of claim 11, wherein the diversion channels and wave generator are further configured so as to be adapted to capture a high energy portion of the waves and to redirect the captured portion of the waves from the distal portion of the body of water to the proximal portion of the body of water at substantially the same time as the wave generator produces a new wave, so that when the captured portion of the waves is redirected to the proximal portion of the body of water, it reinforces the new wave. Johnson teaches away from the current invention because the present invention relates to water rides or activities. More particularly, the present invention is a recreational water feature integrated into a pool having artificially generated waves and/or swells.

In Johnson, US Patent 20100011497, the patent teaches away because the patent does not teach about preventing or mitigating rip currents or removing wave energy from a surf pool do to wave reflection as in the current invention.

SUMMARY OF THE INVENTION

The current invention aims at:

1) Gaining insight in reef properties that influence the wave-driven currents over the reef and associated effects on the surfability parameters; 2) Designing a reef shape optimized for surfing purposes, taking into account both waves and effects of wave driven currents.

In the current invention the design, a rip flow channel was applied in the middle of the reef, where surfers do not surf, to minimize the rip currents through the breakers. In the rip channel no wave breaking occurs and the cross-shore set-up gradients in the channel are thus smaller. The alongshore variations in wave set-up produce feeder currents to the channel and to the sides of the reef. The rip currents through the breakers are therefore, smaller than in a design without a rip channel.

In the current invention shows that three important topographic features affect the wave-driven currents. The first one is the rip channel width; this is the distance between both halves of the reef. By decreasing the rip channel width, the rip current velocities through the channel increase and the rip current strength through the breakers over the reef decrease. This is valid up to a certain width above which the rip current through the channel no longer exists and the rip currents through the breakers increase again. The width of the rip channel does also have a large influence on the stability of the rip currents.

The two other topographic features are the cross- and alongshore extent of the reef. The internal reef angle and reef length are the reef variables used to influence the cross-shore extent of the reef. The internal reef angle again and internal reef slope are the reef variables used to influence the alongshore extent of the reef. In general, the rip current through the channel and the rip currents through the breakers decrease with decreasing reef widths. The rip currents in the reef design in the current invention are approximately 40% decreased in strength in comparison with conventional Artificial Surfing Reefs, (ASR) designs.

The rip currents through the breakers are very asymmetrical; One being almost twice as strong as the other one. The measurements of the surfability parameters: the time series of the surface elevation at the breakpoints of the biochromatic wave field, the peel angles and the breaker types agreed all very well at the side of the reef where the rip current is weak. At the other side, where the rip current is stronger, the surface elevations agreed, but the peel angles and breaker types were very irregular and the water surface are rough at the location of the rip current.

A primitive relationship is found for the effect of rip currents through the breakers on the surfability for typical Dutch swell conditions. This is done by nondimensionalizing the rip currents with the shallow-water wave speed $\sqrt{gh}$ where g is the gravitational constant and h is the water depth. If the Froude number of the rip current is equal to or smaller than 0.1 the rip currents through the breakers have a negligible influence on the surfability. And if the Froude number of the rip is equal to or larger than 0.2 the rip currents through the breakers negatively affect the surfability.

Artificial surf reefs (ASRs) are constructions specially aimed at modifying the nearshore wave field transformation to improve the surf conditions or surfability. With the increasing popularity of surfing, the demand for such artificial reefs in wave pools is ever growing and many more are planned to be constructed in the near future. Artificial Surfing Reefs, (ASRs), are planned to be constructed in big wave pools for indoor surfing. Even though a hot topic, artificial surf reef design is often done fairly ad hoc and there remains great uncertainty as to what the optimal dimensions of the artificial surf reef should be.

Henriquez (2004) investigated, through combination of numerical and experimental modelling, how ASR design affects the resulting surfability. The quality of a surf break is generally expressed in three measurable parameters: breaker height, peel angle and breaker shape. Together these parameters determine the surfability of the wave. In particular, the peel angle (a measure related to the rate at which the wave breaks along its crest) is an important measure that plays a pivoting role in ASR design. The numerical modelling by Henriquez was done without taking into account wave-driven currents. However, his experimental modelling showed that, approximately 20% of the wave ride was negatively affected by rip currents, driven by wave breaking over the ASR. The waves in the rip current were breaking in sections, irregular and with a rough water surface, in other words: unsuitable for surfing. The numerical data (Henriquez, 2004) does not predict the existence of a rip current.

In the previous sections, it is made clear that currents driven by wave breaking on ASRs negatively influence the waves over the reefs and the driving mechanism of these currents over the reef. As the conventional ASRs (without the rip flow channel down the middle of the reef) do not perform well in the presence of wave-driven currents an integral concept for an ASR design is presented taking into account the attendant currents.

The current invention designs a rip current flow channel: (1) to eliminate wave interference on the take-off zones and main part of the wave; (2) to provide the space needed at the take-off and (3) as a paddling channel to give surfers access One of the objectives is to decrease the wave-driven currents which are flowing through the breakers. In this current invention, the rip channel is included to minimize the rip currents at the sides of the reef. This is done by creating a rip-channel in the middle of the reef where surfers do not surf. In the rip channel no wave breaking occurs and the cross-shore set-up gradients in the channel are thus smaller. The alongshore variations in wave set-up produce feeder currents to the channel and to the sides of the reef. The rip currents at the sides of the reef are therefore decreased.

In the current invention design, a rip flow channel was applied in the middle of the reef, where surfers do not surf, to minimize the rip currents through the breakers. In the rip channel no wave breaking occurs and the cross-shore set-up gradients in the channel are thus smaller. The alongshore variations in wave set-up produce feeder currents to the channel and to the sides of the reef. The rip currents through the breakers are therefore, smaller than in a design without a rip channel.

Three important topographic features affect the wave-driven currents. The first one is the rip channel width; this is the distance between both halves of the reef. By decreasing the rip channel width, the rip current through the channel increases and the rip currents through the breakers over the reef decrease. This is valid down to a certain width at which the rip current through the channel does not exist anymore and the rip currents through the breakers increase again. The width of the rip channel does also have a significant influence on the stability of the rip currents. The two other topographic features are the width of the reef perpendicular to the shore and parallel to the shore. The internal reef angle and reef length are the reef variables used to influence the width of the reef perpendicular to the shore. The internal reef angle again and internal reef slope are the reef variables used to influence the width of the reef parallel to the shore. In general, the rip current through the channel and the rip currents through the breaker decrease with decreasing reef widths in any direction.

The rip currents through the breakers are approximately 40% decreased in strength in comparison with a conventional reef. The breaker line is moved off the surf pool beach, the peel angles decrease and the wave heights increase when a strong rip current is flowing through the breakers. In the final design this indication is not noticeable and in the conventional design it is.

By decreasing the rip channel width, the rip current through the channel increases and the rip currents through the breakers over the reef decrease. This is valid down to a certain width at which the rip current through the channel does not exist anymore and the rip currents through the breakers increase again.

The wave energy in the surf pool is removed after the wave breaks over the reef up and into the rip current flow channel. The breaking wave travels into a rip current flow channel. The rip current flow channel then circulates the rip current to the rear of the surf pool. After a wave breaks in the surf pool there is more water at the beach end of the surf pool and less water at the rear end of the surf pool. To maintain equilibrium in the surf pool the breaking water must be returned to maintain balance and necessary water depths for the next breaking wave. The second way the invention functions is, water can be returned to strategic positions on the reef and in the deep-water channels to prevent the outward flow of the rip currents. Therefore, prevents the waves breaking from becoming distorted.

Rip current flow channels can also be strategically placed along the sides of the surf reefs to change the direction and place the rip currents flow. As the wave breaks and moves down the reef wave breaking line rip currents can distort and slow down the wave. This creates a sloppy semi plunging spilling wave. Once the breaking wave clears the rear of the secondary inner surf reef, the rip currents flow to each side of the surf reef. To mitigate the rip currents in the breaking zone, flow channels allow the rip current to flow into the flow channel. The rip current flows toward the rear end of the surf pool via the flow channels, stopping the rip current from distorting the oncoming breaking wave and returning water to the rear of the surf pool. This process restores equilibrium to the surf pool. This process creates a circulation in the surf pool and brings balance back to the wave breaking process in the surf pool.

DESCRIPTION OF THE DRAWINGS

Figure 1:
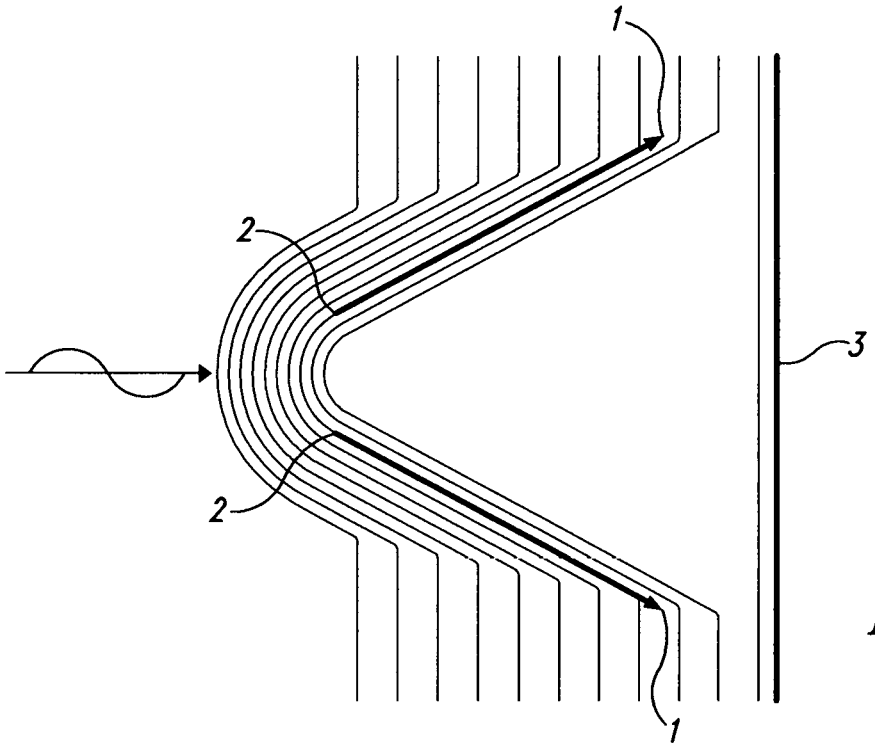
FIG. 1. is a plan view showing an embodiment of the surf pool reef of the present invention with an artificial surf reef, thin solid lines donate depth contours, dashed lines donate breaker line and the thick arrows denote the wave ride of a surfer.

FIG. 1. FIG. 1 is a conventional surf reef without the middle rip current flow channel down the middle of the reef shown with a breaker line 1. Surfers start their wave ride at 2, the take off, and surf along the breaker line to point 1, the end of the wave ride until the surfer reaches the beach 3. The wave between point 2 and point 1 should break in such a manner that they are considered surfable. In order for an Artificial Surf Reef to produce surfable breakers, it is important to understand the characteristics of such breakers.

Figure 2:
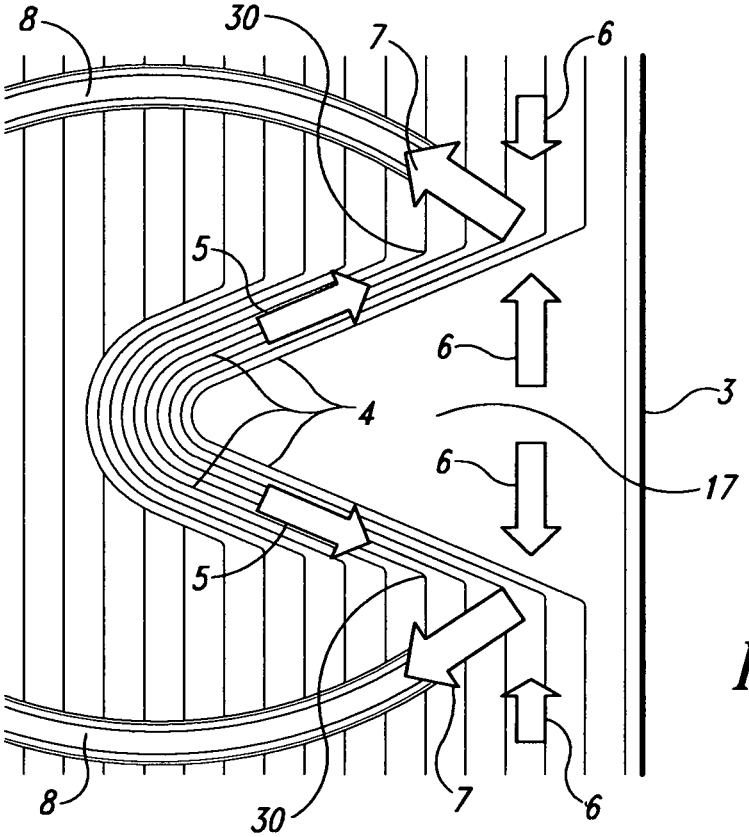
FIG. 2. is a plan view showing an embodiment of the surf pool reef of the present invention with bathymetry of the surf reef where solid lines donate depth contours, white vertical arrows donate the feeder, white diagonal arrows denote the alongshore current and the black diagonal arrows denote the rip current directions and strengths.

FIG. 2. These alongshore variations in wave set-up are leading to alongshore gradients in the water level in the surf zone. These will produce alongshore directed flows, called the feeder currents 5, of water toward the sides of the reef where the water level is lowest. At these points the feeder currents 5 turn to the rear of the artificial surfing reef 17, as a rip current 7 flowing next to the artificial surfing reef 17. The rip current 7 is shown flowing through the wave breaker zone 30. To explain the appearance of the alongshore current, the artificial surf reef is schematized as a sloping shore with straight and parallel depth contours 4, with waves approaching under an angle. These waves are known to induce an alongshore current 6. This alongshore current can be seen as a feeder current 5, flowing to the side of the reef into side rip current flow channels 8.

Figure 3:
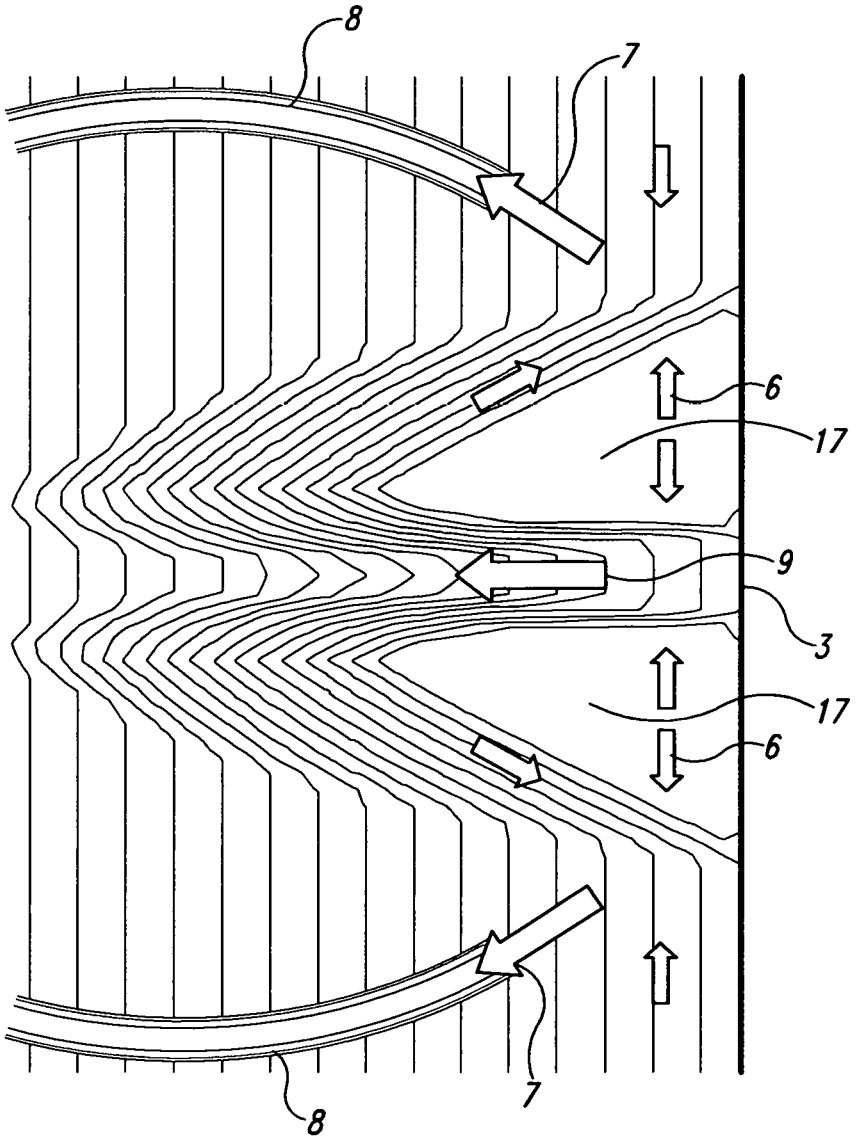
FIG. 3. is a plan view showing an embodiment of the surf pool reef of the present invention with bathymetry of the surf reef where solid lines donate depth contours, white vertical arrows donate the feeder current, white diagonal arrows denote the alongshore current and the black diagonal arrows denote the rip current directions and strengths.

FIG. 3. One of the objectives is to decrease the wave-driven currents which are flowing through the breakers. In this study the middle rip flow channel 9 is included to minimize the rip currents 7 at the sides of the artificial surfing reef 17. This is done by creating a rip-channel 9 in the middle of the reef where surfers do not surf. In the middle rip channel, no wave breaking occurs and the cross-shore set-up gradients in the channel are thus smaller. The alongshore variations 6 in wave set-up produce feeder currents 5 to the channel and to the side currents 7 of the artificial surfing reef. The rip currents at the sides of the reef are therefore expected to decrease.

Figure 4:
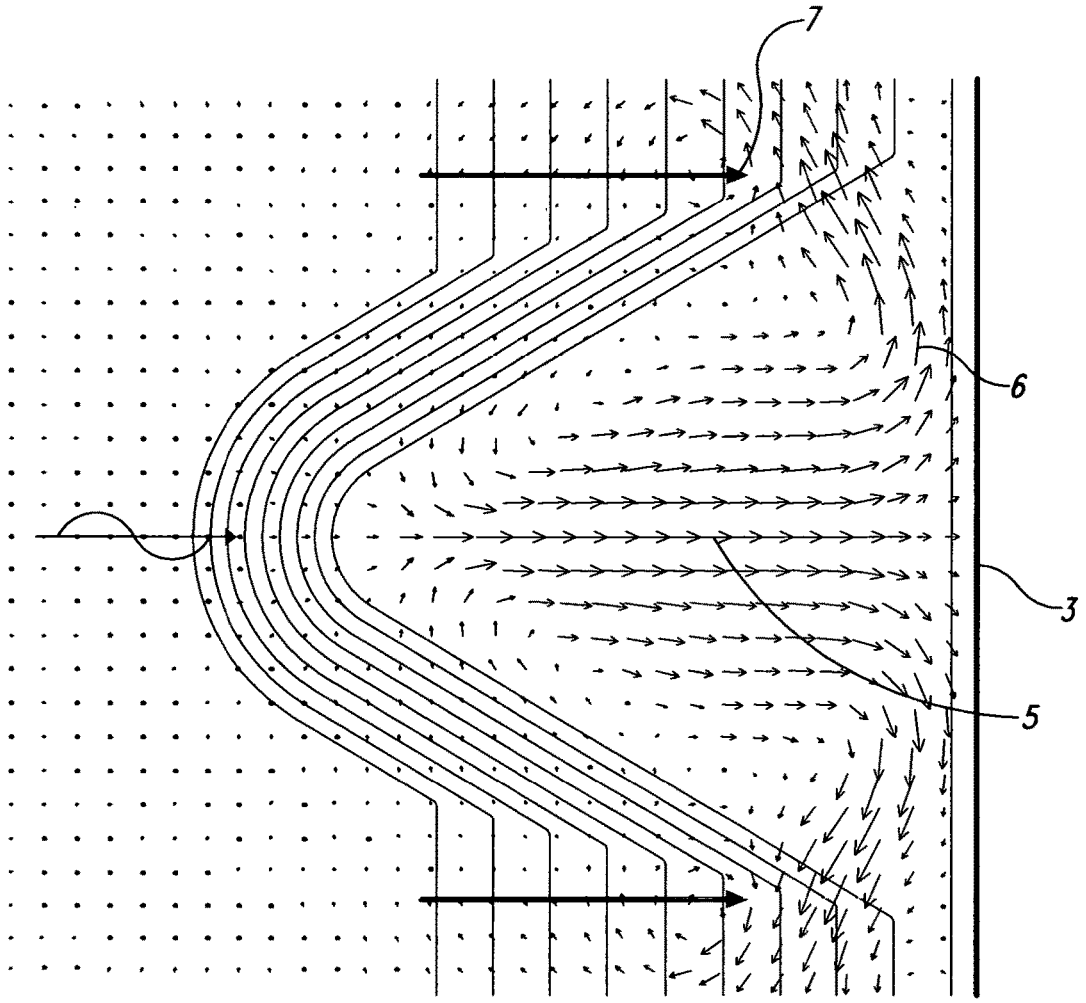
FIG. 4. is a plan view showing an embodiment of the surf pool reef of the present invention with arrows denoting the current directions and magnitudes of the currents, thin solid lines denote the depth contours, the dashed line denotes the breaker line and the thick black lines denote the breaker line without the presences of currents.

FIG. 4. FIG. 4 shows how the currents flow over different parts of the reef. The middle arrows denote the feeder currents 5 and the arrows moving diagonal represent the along shore currents 6. The along shore currents 6 and the feeder currents 5 flow to the side of the reefs via rip flow currents 7.

Figure 5A:
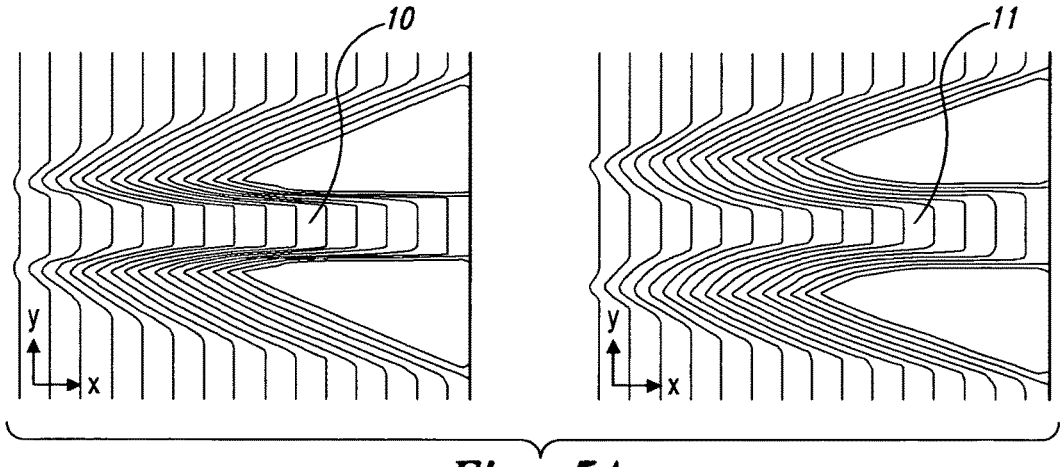
FIG. 5A. is a plan view showing an embodiment of the surf pool reef of the present invention with varying the internal reef slope, step slope on left and mild slope on the right.

FIG. 5A. Varying the internal reef slope, steep slope (left) 10 and mild slope (right) 11.

Figure 5B:
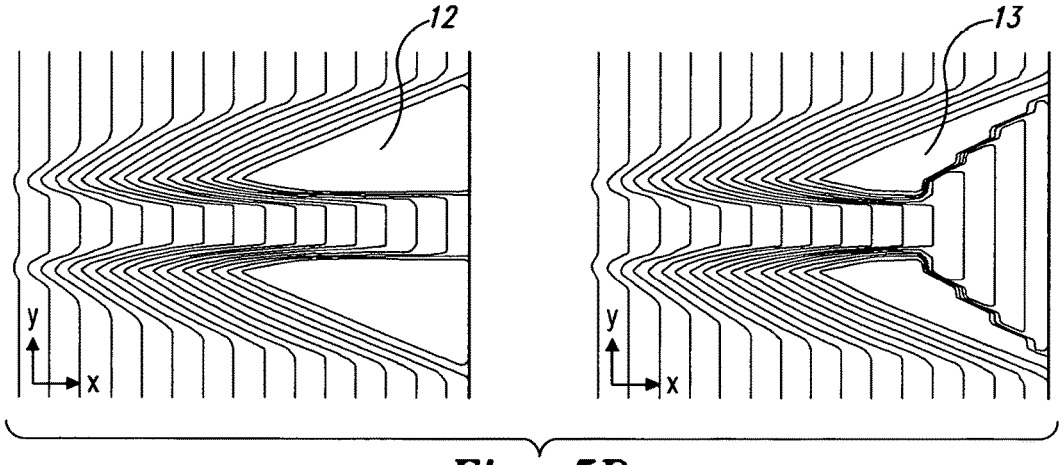
FIG. 5B. is a plan view showing an embodiment of the surf pool reef of the present invention with varying the internal reef angle, small angle left and large angle right.

FIG. 5B. Varying the internal reef angle, small peel angle (left) 12 and large peel angle (right) 13.

Figure 5C:
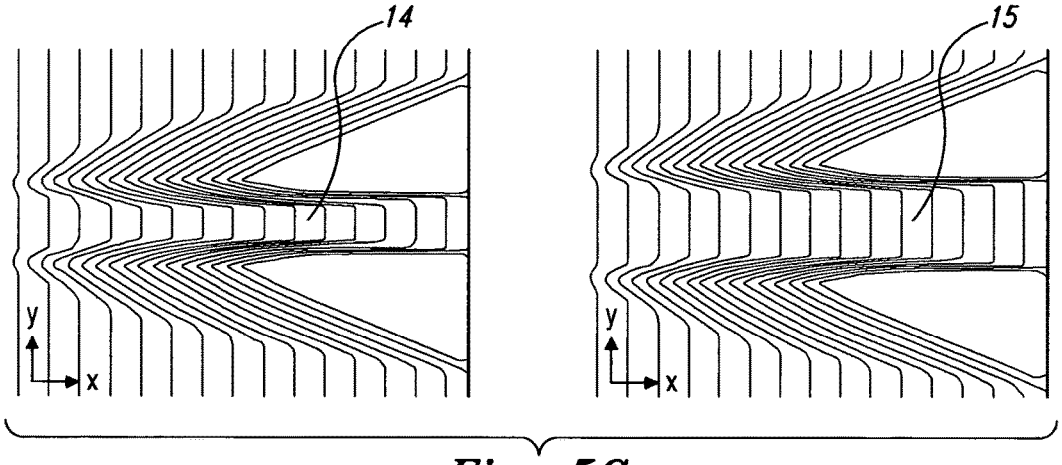
FIG. 5C. is a plan view showing an embodiment of the surf pool reef of the present invention with varying the rip channel width, small width left and large width right.

FIG. 5C. Varying the rip channel width, small width (left) 14 and large width (right) 15.

The currents over the reef with a middle rip channel 9 smaller width 14 are more stable than the currents over the reef with a larger rip channel width. Therefore, a smaller middle rip flow channel width is optimal. The Artificial Surfing Reef design has an optimal internal reef angle of 60 degrees 12, an internal reef slope of 1:1 10, a rip channel width of 10 meters is optimal and is cut just behind the breaker line at the end of the reef.

Figure 6:
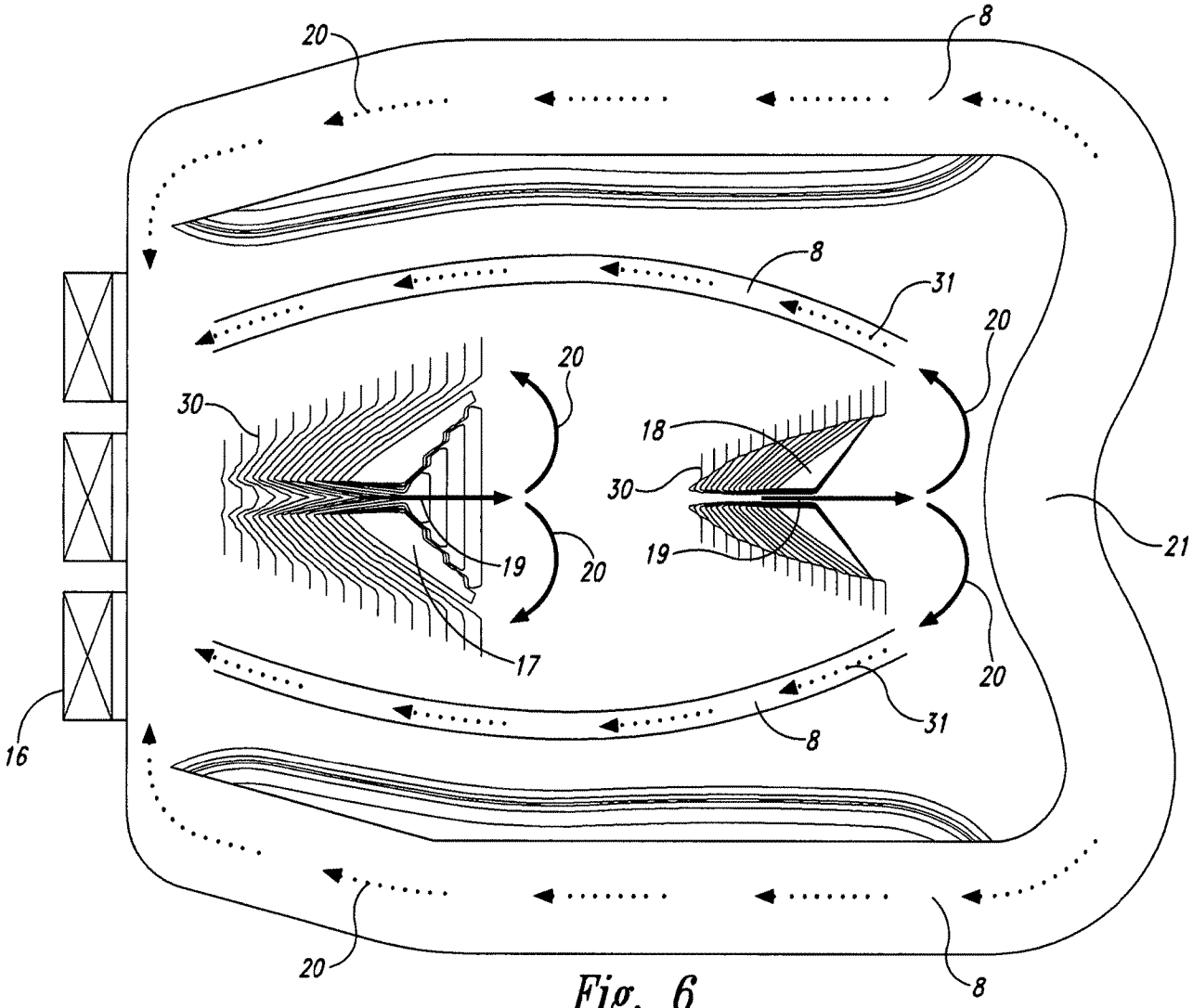
FIG. 6. Top down view of the surf pool showing flow channels on both sides of surf reef.

FIG. 6. Demonstrates how the rip current flow channel mitigation system operates. The surf pool shows two reefs in the surf pool, a premier first reef 17 and a secondary inner artificial surfing reef 18. The wave breaks and moves down the reef wave breaking line 30. Once the breaking wave clears the rear of the secondary inner artificial surf reef 17, the rip currents 20 flow to each side of the artificial surf reef. To mitigate the rip currents in the breaking zone 30, flow channels 8 allow the rip current to flow into the flow channel. The solid black arrows 31 represent the rip current flow moving toward the rear end of the surf pool via the flow channels 8, stopping the rip current from distorting the oncoming breaking wave and returning water to the rear of the surf pool. This process restores equilibrium to the surf pool. This process creates a circulation in the surf pool and brings balance back to the wave breaking process in the surf pool. A secondary rip current flow channel 8 is located behind secondary artificial surfing reef 18 and transports the rip current flow back to the rear of the surf pool. The wave swell is generated from the wave generators at 16.

The invention claimed is:

1. A surf pool comprising of a wave dampening rip current mitigation system including of at least one rip current flow channel down a middle of an artificial surfing reef and, wherein a rip flow channel located on a sides of the artificial surfing reef minimizes rip current at wave breaking zones and, wherein the rip current flow channels has different contoured slopes, widths and depths to decrease or increase rip current speeds and, wherein the at least one rip flow channel in the middle of the artificial surfing reef ranges from 5 meters to 15 meters in width and, wherein the rip current flow channel along the sides of the artificial surfing reef is 1 to 5 meters wide and 1 meter deep and, wherein the at least one rip flow channel in the middle of the artificial surfing reef has an internal slope of 1/1 to 1/3 and, wherein the artificial surfing reef has different internal reef angles from 25 degrees to 70 degrees to decrease the rip current energy in a wave breaking zones, wherein the rip current flow channels divert a rip currents outside of a wave breaking zones.

2. A surf pool as recited in claim 1, further comprising a wave catch basin and, wherein a return flow channel is connected to each side of the wave catch basin and, wherein the water collected in the wave catch basin is returned to the rear of the surf pool to maintain equilibrium in the surf pool.

* * * * *